US010724801B2

(12) United States Patent
Mohammadian et al.

(10) Patent No.: US 10,724,801 B2
(45) Date of Patent: Jul. 28, 2020

(54) HEAT EXCHANGER PLATE AND A PLATE HEAT EXCHANGER

(71) Applicant: ALFA LAVAL CORPORATE AB, Lund (SE)

(72) Inventors: Mehrdad Mohammadian, Helsingborg (SE); Jens Romlund, Helsingborg (SE)

(73) Assignee: ALFA LAVAL CORPORATE AB, Lund (CH)

( * ) Notice: Subject to any disclaimer, the term of this patent is extended or adjusted under 35 U.S.C. 154(b) by 97 days.

(21) Appl. No.: 15/571,426

(22) PCT Filed: Apr. 25, 2016

(86) PCT No.: PCT/EP2016/059177

§ 371 (c)(1),
(2) Date: Nov. 2, 2017

(87) PCT Pub. No.: WO2016/180625

PCT Pub. Date: Nov. 17, 2016

(65) Prior Publication Data

US 2019/0033003 A1 Jan. 31, 2019

(30) Foreign Application Priority Data

May 11, 2015 (EP) ..... 15167096

(51) Int. Cl.
*F28D 9/00* (2006.01)
*F28F 9/007* (2006.01)
*F28F 9/02* (2006.01)

(52) U.S. Cl.
CPC ..... *F28D 9/005* (2013.01); *F28F 9/0075* (2013.01); *F28F 9/026* (2013.01)

(58) Field of Classification Search
CPC ..... F28F 3/08; F28F 3/083; F28F 3/10; F28F 2225/00; F28D 9/005
See application file for complete search history.

(56) References Cited

U.S. PATENT DOCUMENTS 4,063,591 A * 12/1977 Usher ..... F28F 3/083 165/167
4,987,955 A 1/1991 Bergqvist et al.
(Continued)

FOREIGN PATENT DOCUMENTS

CN 1287610 A 3/2001
CN 1492153 A 4/2004
(Continued)

OTHER PUBLICATIONS

An English Translation of the Office Action (Notice of Reasons for Rejection) dated Oct. 22, 2018, by the Japanese Patent Office in corresponding Japanese Patent Application No. 2017-559024. (5 pages).

(Continued)

*Primary Examiner* — Eric S Ruppert
(74) *Attorney, Agent, or Firm* — Buchanan Ingersoll & Rooney PC

(57) ABSTRACT

A heat exchanger plate comprises a heat exchanger area, at least two portholes each having a diameter, and at least two porthole areas. Each of the portholes is surrounded by a respective one of the porthole areas. The porthole areas are separated from each other. Each porthole area comprises a corrugation of beams. Each of the beams has an end and extends along a respective extension direction towards the porthole. The extension direction of each of the beams forms an acute angle to a radial line through the end of the beam.

19 Claims, 6 Drawing Sheets

(56) References Cited

U.S. PATENT DOCUMENTS

| | | | | |
|---|---|---|---|---|
| 6,062,305 | A * | 5/2000 | Persson | F28F 3/083 165/167 |
| 6,394,178 | B1 | 5/2002 | Yoshida et al. | |
| 8,109,326 | B2 | 2/2012 | Larsson et al. | |
| 8,662,151 | B2 | 3/2014 | Gustafsson | |
| 2001/0030043 | A1 | 10/2001 | Gleisle et al. | |
| 2003/0094271 | A1 | 5/2003 | Leuthner et al. | |
| 2004/0065433 | A1 | 4/2004 | Meshenky et al. | |
| 2011/0024097 | A1 | 2/2011 | Christensen et al. | |
| 2011/0036547 | A1 | 2/2011 | Christensen et al. | |
| 2011/0088882 | A1 | 4/2011 | Persson | |
| 2011/0290462 | A1 | 12/2011 | Andersson et al. | |
| 2013/0192291 | A1 | 8/2013 | Ito et al. | |

FOREIGN PATENT DOCUMENTS

| | | | |
|---|---|---|---|
| CN | 1174213 | C | 11/2004 |
| CN | 102016480 | A | 4/2011 |
| CN | 103201583 | A | 7/2013 |
| DE | 199 17 761 | C1 | 1/2001 |
| EP | 1 070 928 | A1 | 1/2001 |
| JP | S63-023579 | U | 2/1988 |
| JP | H11-514731 | A | 12/1999 |
| JP | 2007-528978 | A | 10/2007 |
| JP | 2011-517763 | A | 6/2011 |
| KR | 10-2010-0128317 | A | 12/2010 |
| WO | 97/16691 | A1 | 5/1997 |
| WO | WO 02/08680 | A1 | 1/2002 |
| WO | 2005/088221 | A1 | 9/2005 |
| WO | WO 2007/036963 | A1 | 4/2007 |
| WO | 2009/123517 | A1 | 10/2009 |
| WO | 2009/123519 | A1 | 10/2009 |
| WO | WO 2011/073083 | A1 | 6/2011 |

OTHER PUBLICATIONS

An English Translation of the First Office Action dated Jan. 2, 2019, by the State Intellectual Property Office of People's Republic of China in corresponding Chinese Patent Application No. 201680027328.X. (5 pages).

Office Action dated Oct. 9, 2018, by the Swedish Patent and Registration Office in corresponding Swedish Patent Application No. 1650552-1. (8 pages).

An English Translation of the Office Action (Notice of Preliminary Rejection) dated Dec. 19, 2018, by the Korean Patent Office in corresponding Korean Patent Application No. 10-2017-7035197. (4 pages).

International Search Report (PCT/ISA/210) dated Jul. 4, 2016, by the European Patent Office as the International Searching Authority for International Application No. PCT/EP2016/059177.

Written Opinion (PCT/ISA/237) dated Jul. 4, 2016, by the European Patent Office as the International Searching Authority for International Application No. PCT/EP2016/059177.

* cited by examiner

HEAT EXCHANGER PLATE AND A PLATE HEAT EXCHANGER

TECHNICAL FIELD OF THE INVENTION

The present invention refers to a heat exchanger plate comprising a heat exchanger area, at least two portholes each having a diameter, at least two porthole areas, wherein each of the portholes is surrounded by a respective one of the porthole areas, wherein the porthole areas are separated from each other, wherein each porthole area has a corrugation of beams, and wherein each of the beams has an end and extends along a respective extension direction towards the porthole.

The present invention also refers to a plate heat exchanger having such a heat exchanger plate.

BACKGROUND OF THE INVENTION AND PRIOR ART

The porthole areas of such heat exchanger plates of a plate heat exchanger are subjected to strong and varying loads during operation of the plate heat exchanger. When the pressure increases in every second plate interspace, large pulling forces arise in the porthole areas, which tend to pull adjacent heat exchanger plates apart, especially in case of brazed or welded plate heat exchangers. In particular, large forces will thus appear at and around the contact zones of the beams in the porthole areas.

Providing the contact zones at the end portions of the beams is disadvantageous since the thickness of the material of the porthole areas of the heat exchanger plate is thinnest at the end portion of the beam, where the material is bent and deformed in several directions. Therefore the end portions are not suitable for taking up large loads. If the contact zones are located at the end portions of the beams there will thus exist a risk for cracks in the material of the heat exchanger plates.

Plate heat exchangers, where the beams of the heat exchanger area continues in the same direction into the porthole area, will have irregularly positioned contact zones in the porthole area. In other words some contact zones will be located close to the porthole and some more remote from the porthole. Furthermore, the distance between adjacent contact zones in the porthole area will vary around the porthole. This is disadvantageous with regard to the strength of the porthole area.

U.S. Pat. No. 8,109,326 discloses a heat transfer plate intended to constitute, together with other heat transfer plates, a plate stack with permanently connected plates for a heat exchanger, which heat transfer plate has a first long side and an opposite second long side, a first short side and an opposite second short side, a heat transfer surface exhibiting a pattern of ridges and valleys, first and second port regions, the first port region being situated in a first corner portion formed at the meeting between the first long side and the first short side, the second port region being situated in a second corner portion formed at the meeting between the second long side and the first short side, and the first port region being connected to a number of ridges and valleys, which ridges and valleys have in principle an extent from the first port region diagonally towards the second long side.

WO 201173083 discloses a heat exchanger plate including a bottom that has four fluid passage openings placed, respectively, in four corner regions, said bottom being provided with chevron-patterned waves extending from both sides of a median longitudinal axis of the plate. The waves of the plate are intended to intersect with the waves of an identical adjacent plate in a vertically adjacent relationship in which both plates are rotated 180°, thus forming point-by-point contact areas for the mutual brazing thereof. The bottom has, in the corner regions and near the passage openings, supplementary raised areas that are capable of defining supplementary point-by-point contact areas for the brazing, thus making it possible to improve the resistance to pressure from the heat exchanger.

SUMMARY OF THE INVENTION

The object of the present invention is to remedy the problems discussed above. In particular, it is aimed at an improvement of the strength of the porthole area around the portholes of the heat exchanger plate, and thus an improvement of the strength of the plate heat exchanger.

This object is achieved by the heat exchanger plate initially defined and characterized in that the extension direction of each of the beams forms an acute angle to a radial line through the end of the beam.

Such beams being inclined with respect to a radial line result in advantageous solution that the opposing beams of the porthole areas of adjacent heat exchanger plates of the plate heat exchanger will cross each other at a contact zone located at a distance from the end of the respective beams. The contact zone in the proximity of the end of the beams, where the material of the beams is thinnest, may thus be avoided. Consequently, the heat exchanger plate as claimed result in an improved strength of the porthole area, and thus of the plate heat exchanger.

According to an embodiment of the invention, the acute angle is substantially equal, or equal, for each of the beams. This feature contributes to all contact zones being located at the same distance from the end of the beam, and at the same distance from the porthole. Consequently, a uniform strength of the porthole area around the porthole may be achieved.

According to a further embodiment of the invention, the beams are substantially equidistantly, or equidistantly, provided around the porthole. Also this feature contributes to a uniform strength of the porthole area around the porthole, since the load will be uniformly distributed around the porthole.

According to a further embodiment of the invention, the extension direction of each beam is tangential with respect to a circle, which has a diameter smaller than the diameter of the porthole and is concentric with the porthole. This definition follows of the acute angle defined above.

According to a further embodiment of the invention, the acute angle $\alpha$ is larger than 10°. The acute angle $\alpha$ may be larger than 20°. The acute angle $\alpha$ may be larger than 30°. The acute angle $\alpha$ may be larger than 40°.

According to a further embodiment of the invention, the acute angle $\alpha$ is smaller than 80°. The acute angle $\alpha$ may be smaller than 70°. The acute angle $\alpha$ may be smaller than 60°. The acute angle $\alpha$ may be smaller than 50°.

According to a further embodiment of the invention, the diameter of the circle is shorter than 80% of the diameter of the porthole.

The diameter of the circle may be shorter than 70% of the diameter of the porthole. The diameter of the circle may be shorter than 60% of the diameter of the porthole.

According to a further embodiment of the invention, the diameter of the circle may be longer than 20% of the diameter of the porthole. The diameter of the circle may be longer than 30% of the diameter of the porthole. The diameter of the circle may be longer than 40% of the diameter of the porthole.

According to a further embodiment of the invention, the end of each beam is located at a distance from the porthole. Thus there may be an annular flat area around the porthole. The annular flat area may extend between the porthole and the end of the beams of the porthole area. Such a flat annular area contributes to strengthening the porthole area.

According to a further embodiment of the invention, each of the beams of the porthole area has an elongated shape along said extension direction.

Advantageously, the elongated shape may be straight or substantially straight.

According to a further embodiment of the invention, each of the beams has an opposite end. The opposite end may be located close to the heat exchanger area. Thus, each of the beams of the porthole area may extend from the opposite end towards the porthole to the end of the beam.

According to a further embodiment of the invention, the opposite end of each beam is located within the respective porthole area.

According to a further embodiment of the invention, the opposite end of each beam is located at a distance from the beams of a corrugation of the heat exchanger area.

Advantageously, there may then be an annular area, possibly flat, between the opposite end of the beams of the porthole area and the heat exchanger area, or the beams of the heat exchanger area.

According to a further embodiment of the invention, the opposite end of at least some of the beams is connected to a beam, or at least one beam, of a corrugation of the heat exchanger area.

Preferably, more than 50% of the beams of the porthole area are connected to a beam of the corrugation of the heat exchanger area.

According to a further embodiment of the invention, each beam has a curved shape thereby crossing the extension direction twice. Such a curved shape of the beam permits each beam to form two contact zones, which may contribute to an even higher strength of the porthole area.

The object is also achieved by the plate heat exchanger initially defined and comprising a plurality of heat exchanger plates as defined above.

According to a further embodiment of the invention, each beam of the porthole areas of one heat exchanger plate forms a contact zone with a beam of one of the porthole areas of an adjacent heat exchanger plate.

For instance, every second heat exchanger plate in the plate heat exchanger may be rotated 180° in relation to the remaining heat exchanger plates. It is also possible two include two or more kinds of heat exchanger plates in the plate heat exchanger, for instance every second heat exchanger plated may have an inverted pattern.

According to a further embodiment of the invention, each beam has a curved shape thereby crossing the extension direction twice, and wherein each beam of the porthole area of one heat exchanger plate forms two contact zones. With two contact zones, which both are located at a distance from the end of the beam, the strength of the porthole are may be further improved.

Advantageously, both contact zones are located also at a distance from the opposite end of the beam.

According to a further embodiment of the invention, each beam of the porthole area of one heat exchanger plate forms two contact zones with two beams of the porthole area of an adjacent heat exchanger plate.

BRIEF DESCRIPTION OF THE DRAWINGS

The present invention is now to be explained more closely through a description of various embodiments and with reference to the drawings attached hereto.

DETAILED DESCRIPTION OF VARIOUS EMBODIMENTS

Figure 1:
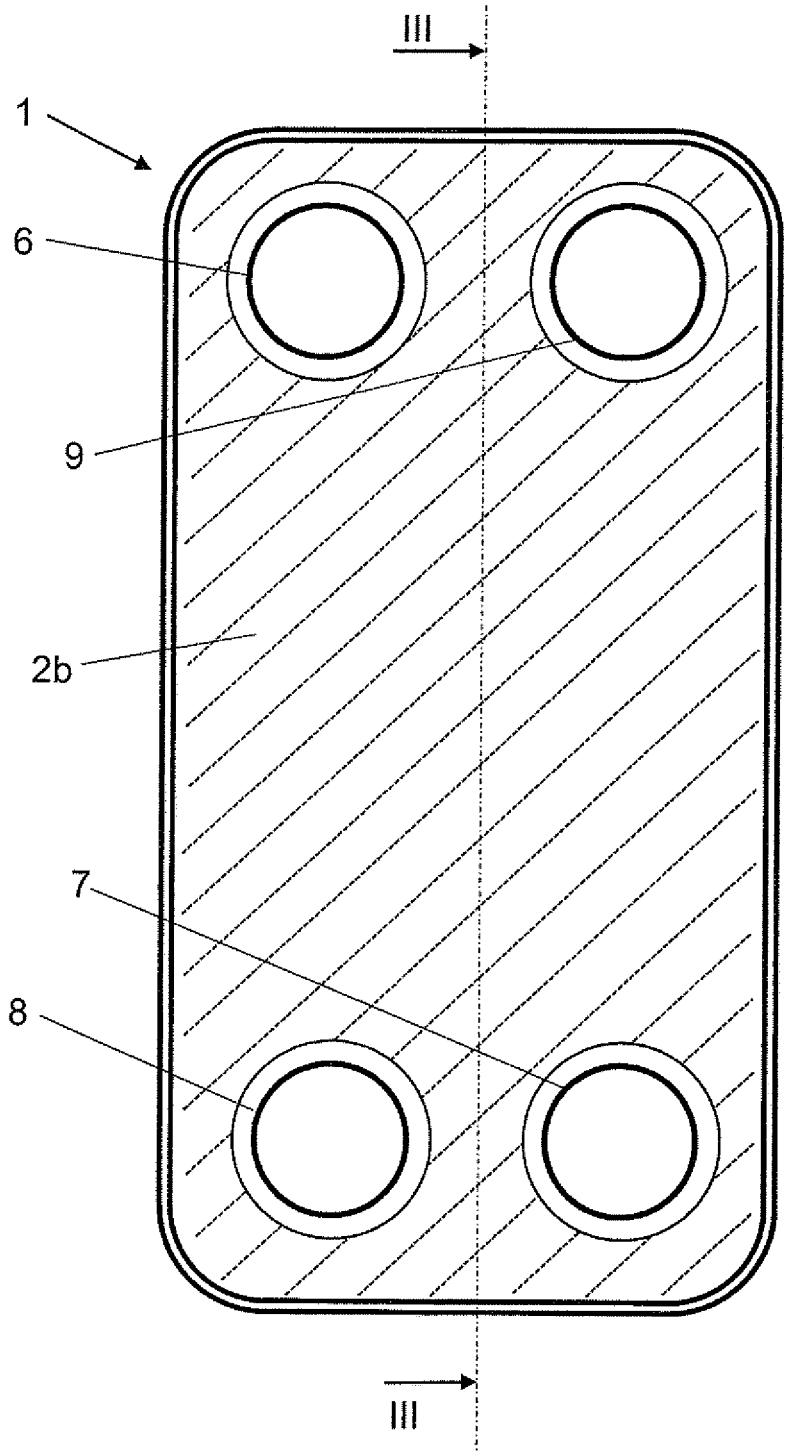
FIG. 1 discloses schematically a front view of a plate heat exchanger according to a first embodiment of the invention.
Figure 2:
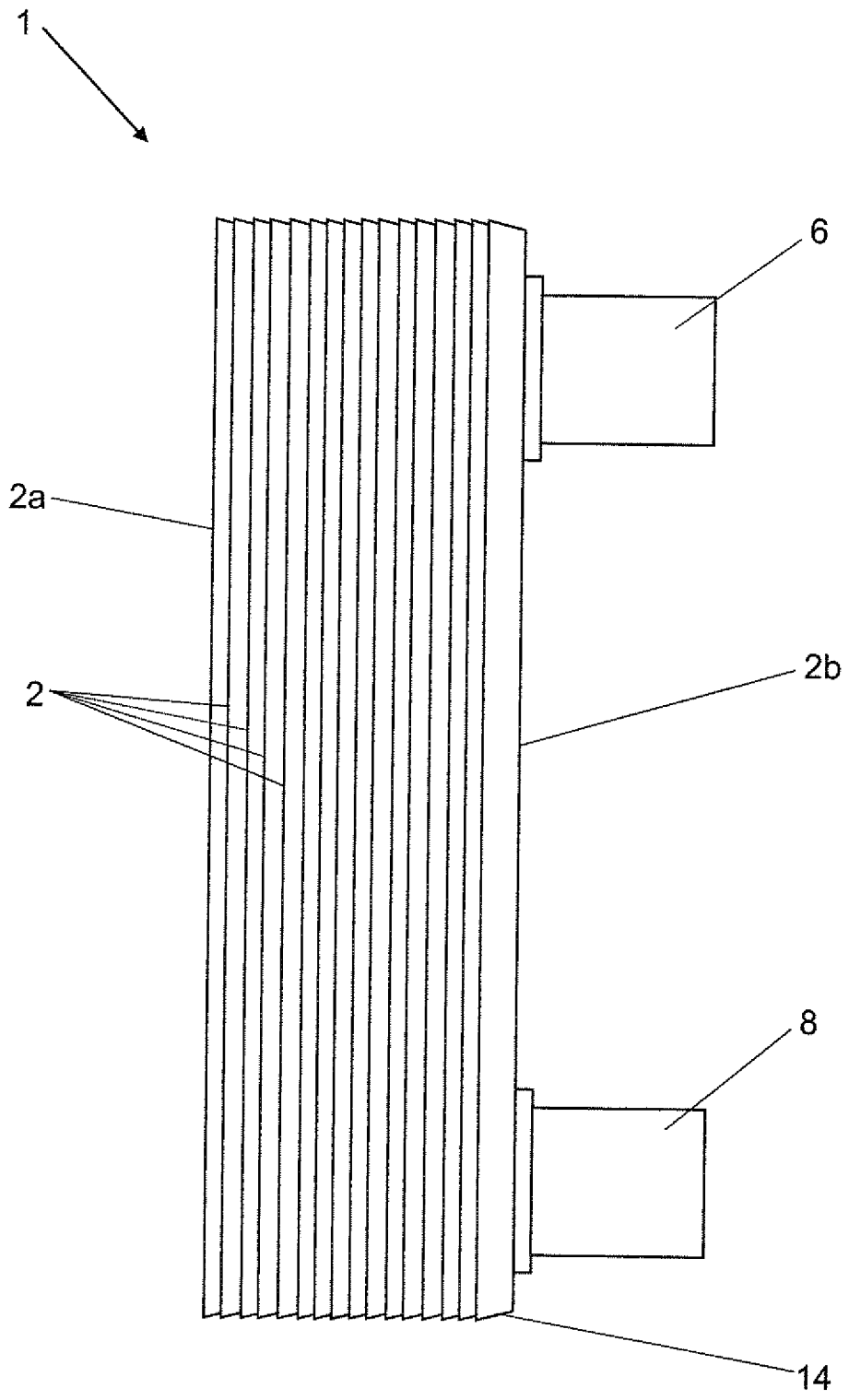
FIG. 2 discloses schematically a side view of the plate heat exchanger in FIG. 1.
Figure 3:
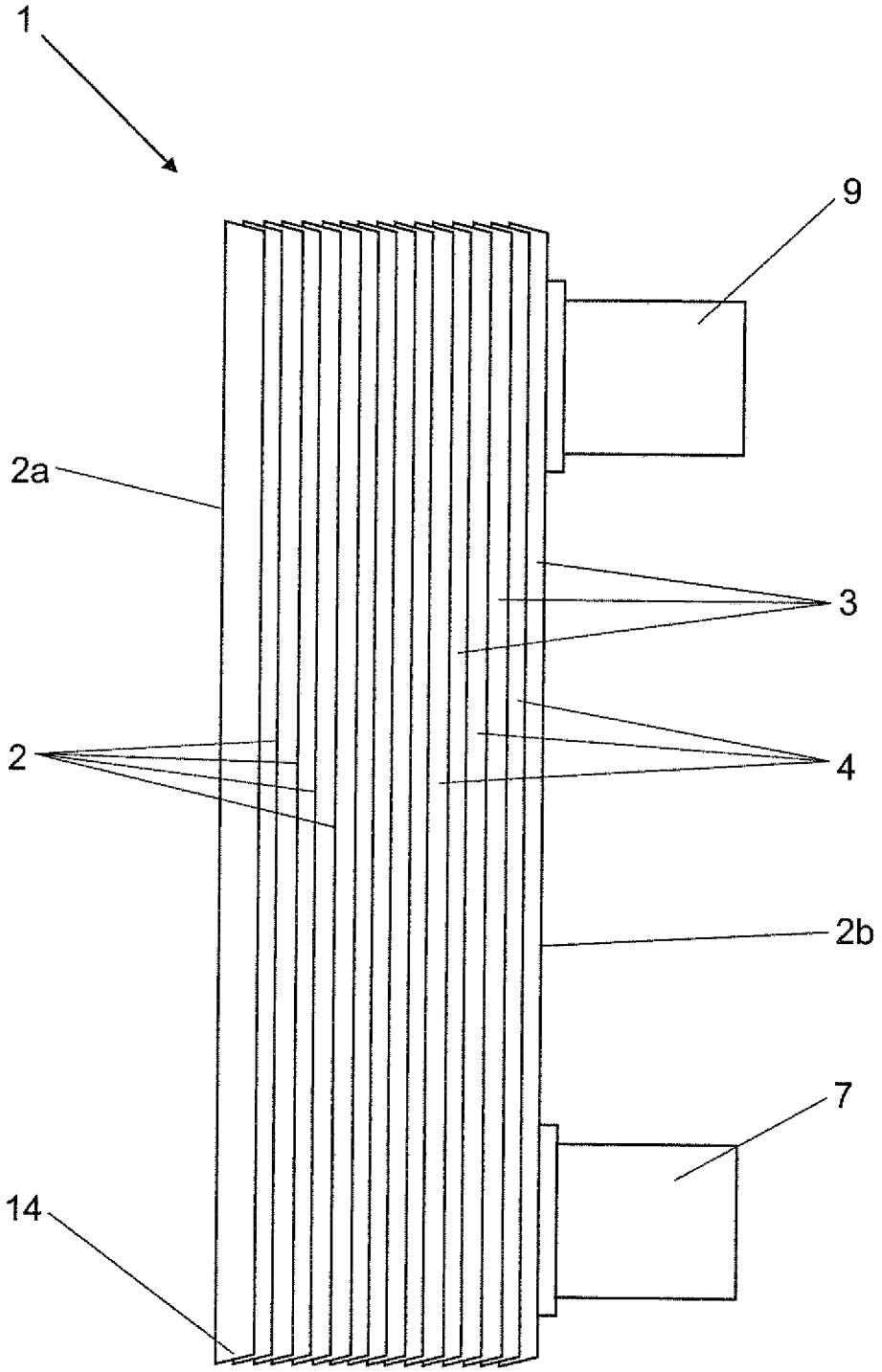
FIG. 3 discloses schematically a longitudinal section through the plate heat exchanger along line III-III in FIG. 1.

FIGS. 1-3 disclose a plate heat exchanger 1 comprising a plate package of a plurality of heat exchanger plates 2. The heat exchanger plates 2 comprises a pressure plate 2*a*, which may form an outermost plate, and a frame plate 2*b*, which may form the other outermost plate.

The heat exchanger plates 2 form first plate interspaces 3 for a first medium and second plate interspaces 4 for a second medium, see FIG. 3. The first plate interspaces 3 and the second plate interspaces 4 are arranged in an alternating order in the plate heat exchanger 1.

The plate heat exchanger 1 comprises a first inlet 6 for the first medium, a first outlet 7 for the first medium, a second inlet 8 for the second medium and a second outlet 9 for the second medium.

Figure 4:
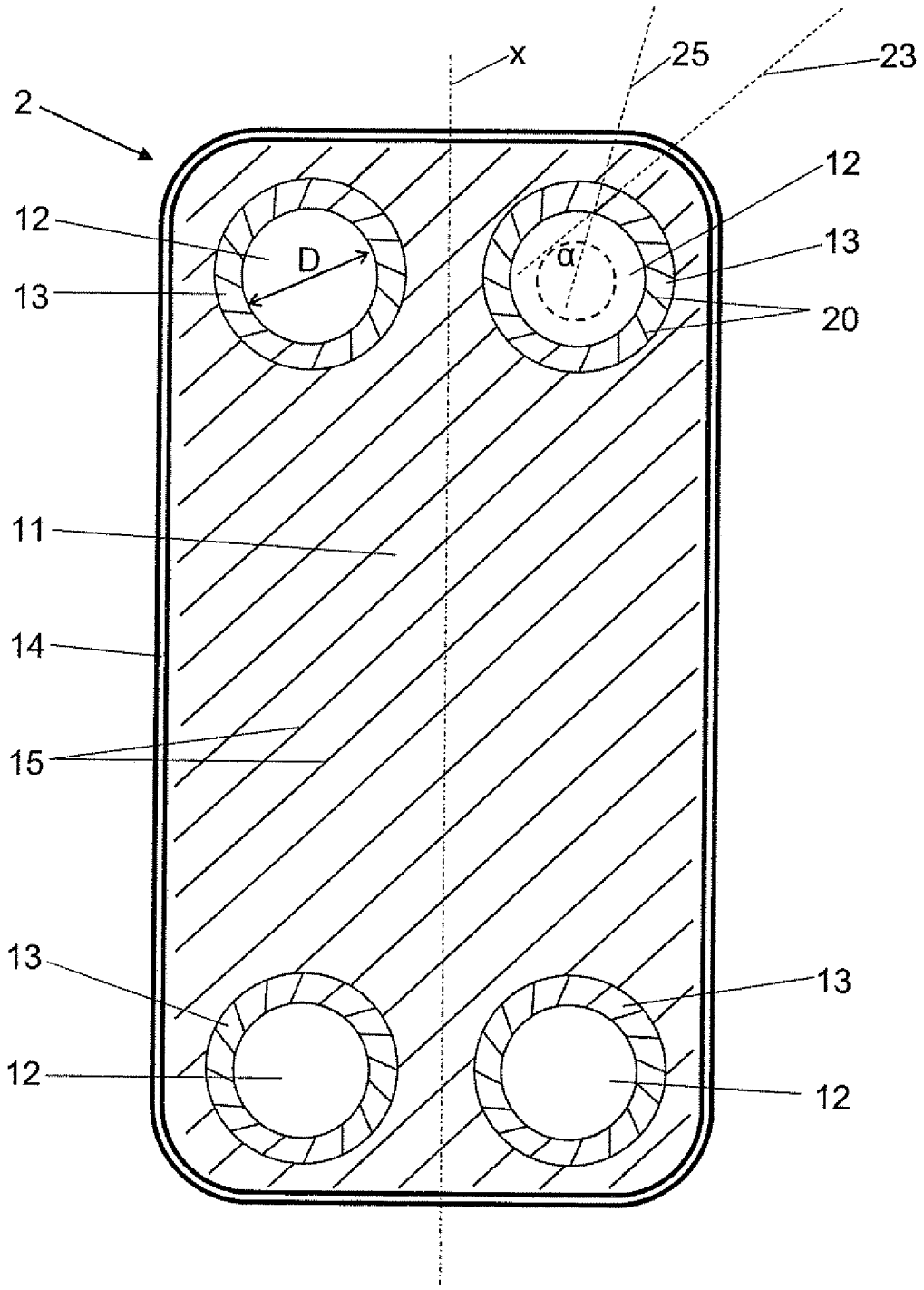
FIG. 4 discloses schematically a plane view of a heat exchanger plate of the plate heat exchanger in FIG. 1.

One of the heat exchanger plates 2 is disclosed in FIG. 4. In the embodiments disclosed, all heat exchanger plates 2 are identical. Also the pressure plate 2*a* and the frame plate 2*b* may be identical to the remaining heat exchanger plates 2.

In the plate heat exchanger 1, every second plate 2 is rotated 180°.

However, it should be noted that the heat exchanger plates do not need to be identical, but for instance every second heat exchanger plate may be inverted, i.e. the pattern of the heat exchanger plate is inverted. The plate heat exchanger may thus comprise two or more different kinds of heat exchanger plates.

According to the first embodiment, each heat exchanger plate 2 comprises a heat exchanger area 11 and four portholes 12. A longitudinal central axis x extends along the heat exchanger plate 2.

It is to be noted that each heat exchanger plate 2 may comprise another number of portholes 12, for instance two, one for the inlet and one for the outlet of the first medium, wherein the inlet and the outlet for the second medium are formed by open sides in the plate package. It is also possible with more than four portholes, for instance in the case of more than two media.

Each porthole 12 has a diameter D.

Each porthole 12 is surrounded by a respective one of a porthole area 13 (porthole surrounding area). The porthole areas 13 are separated from each other as can be seen in FIG. 4.

In the embodiments disclosed, each of the porthole areas 13 is annular, i.e. each porthole area 13 extends all the way around the respective porthole 12.

In the embodiments disclosed, each porthole 12 and porthole area 13 are circular, or substantially circular. It is to be noted, that the porthole 12 and porthole area may have a shape deviating from a circular shape, for instance an oval or elliptic shape, or a polygonal-like shape.

In the embodiments disclosed, the four portholes 12 and porthole areas 13 are identical. It is to be noted, however, that the porthole 12 and porthole areas 13 may differ from each other, for instance with respect to the size of the porthole 12 and porthole area 13.

The heat exchanger plate 2 also comprises an edge area 14 forming the outer part of the heat exchanger plate 2. The edge area 14 surrounds the heat exchanger area 11.

In the embodiments disclosed, the edge area 14 is configured as a flange which is bent away from the heat exchanger area 11, as can be seen in FIGS. 2 and 3.

In the embodiments disclosed, the heat exchanger plates 2 are permanently joined to each other, for instance through brazing, welding or gluing. A permanent joint may extend along the flanges of the edge areas 14 of two adjacent heat exchanger plates 2. The plate interspaces 3, 4 enclosed between the two adjacent heat exchanger plates 2 may thus be sealed.

In the first embodiment, the porthole areas 13, with the respective porthole 12, are located on the heat exchanger area 11 at a distance from the edge area 14. However, it is to be noted that the porthole area 13 may be located adjacent to the edge area 14, see for instance FIG. 6.

The heat exchanger area 11 has a corrugation of beams 15 forming ridges and valleys in a manner known per se. In the embodiments disclosed, the beams 15 of the corrugation of the heat exchanger area 11 all extend diagonally in the same direction. The beams 15 form an angle to the longitudinal central axis x.

It is to be noted that the pattern of the corrugation of beams 15 of the heat exchanger area 11 may be different than disclosed, for instance a so called fish-bone pattern, where the beams 15 form an arrow-like pattern. The corrugation may also be different in different sections of the heat exchanger area 11.

Furthermore, there may be a different corrugation of the heat exchanger area 11 adjacent to the porthole areas 13 to form so called distribution areas.

Each porthole area 13 also comprises a corrugation of beams 20 forming ridges and valleys at the porthole area 13. Each of the beams 20 of the porthole area 13 has an end 21 turned towards the porthole 12, and an opposite end 22 turned towards the heat exchanger area 11 or towards the edge area 14, see also FIG. 6.

Each of the beams 20 of the porthole area 13 extends along a respective extension direction 23 towards the porthole 12. Each beam 20 of the porthole area 13 has an elongated shape along the extension direction 23. In the first embodiment, the elongated shape is straight or substantially straight.

Figure 5:
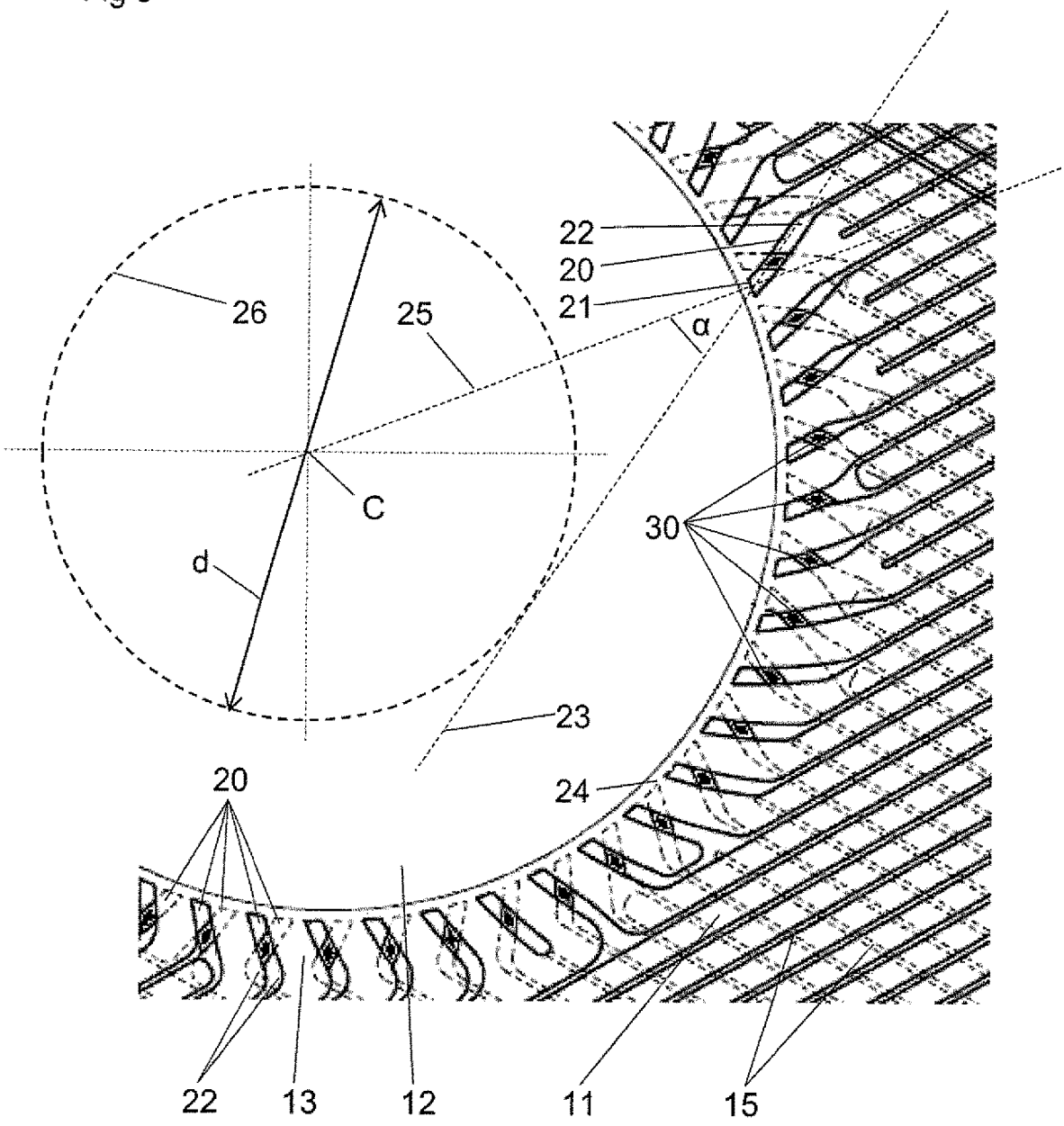
FIG. 5 discloses a more detailed plan view of a part of a porthole area of the heat exchanger plate in FIG. 4.

In the first embodiment, the end 21 of each beam 20 of the porthole area 13 is located at a distance from the porthole 12, as can be seen in FIG. 5. There is thus an annular flat area 24 between the porthole 12, and the end 21 of the beams 20 of the porthole area 13.

The opposite end 22 of each beam 20 of the porthole area 13 is located within the respective porthole area 13. In the first embodiment, the opposite end 22 of at least some of the beams 20 is connected to a beam 15 of the corrugation of the heat exchanger area 11.

FIG. 5, which shows only a part of the porthole area 13, discloses one beam 20 which is not connected to any beam 15 of the heat exchanger area 11. There may of course be more than one beam 20 of the porthole area 13 that is not connected to any beam 15 of the heat exchanger area 11. For instance 2, 3, 4, 5, 6, 7, 8 or even more beams 20 of the porthole area 13 may not connected to any beam 15 of the heat exchanger area 11.

FIG. 5 also discloses at least three beams 20 of the porthole area 13 that are connected to two beams 15 of the heat exchanger area 11. Also this number of beams 20 may be larger or smaller.

Furthermore, FIG. 5 shows an example of two beams 20 of the porthole area 13 being connected to one and the same beam 15 of the heat exchanger area 11.

The extension direction 23 of each of the beams 20 of the porthole area 13 forms an acute angle $\alpha$ to a radial line 25, which extends through the end 21 of the beam 20 of the porthole area 13 and through a center C of the porthole.

The acute angle $\alpha$ is substantially equal, or equal, for each of the beams 20 of the porthole area 13.

The acute angle $\alpha$ may be larger than 10°, larger than 20°, larger than 30°, or larger than 40°.

Furthermore, the acute angle $\alpha$ may be smaller than 80°, smaller than 70°, smaller than 60°, or smaller than 50°.

For instance, the acute angle $\alpha$ may be 45°, or approximately 45°.

Thus, the extension direction 23 of each beam 20 of the porthole area 13 is tangential with respect to a circle 26. The circle 26 has a diameter d which is smaller than the diameter D of the porthole 12. The circle 26 is concentric with the porthole 12, i.e. the center C of the circle 26 forms the center of the porthole 12.

The diameter d of the circle 26 may be shorter than 80% of the diameter D of the porthole 12, may be shorter than 70% of the diameter D of the porthole 12, or may be shorter than 60% of the diameter D of the porthole 12.

Furthermore, the diameter d of the circle 26 may be is longer than 20% of the diameter D of the porthole 12, may be is longer than 30% of the diameter D of the porthole 12, or may be is longer than 40% of the diameter D of the porthole 12.

The beams 20 of the porthole area 12 are equidistantly provided around the porthole 12.

FIG. 5 illustrates two heat exchanger plates 2 of the plate package of the plate heat exchanger 1. The beams 15 and 20 of the first heat exchanger plate 2 are shown with continuous lines, whereas the beams 15 and 20 of the second adjacent and underlying heat exchanger plate 2 are shown with dashed lines. As indicated above, the second heat exchanger plate 2 is rotated 180° in relation to the first heat exchanger plate 2.

Each beam 20 of the porthole area 13 of the first heat exchanger plate 2 form a contact zone 30 with a beam 20 of the porthole area 13 of the second heat exchanger plate 2. As can be seen in FIG. 5, the contact zones 30 are located at a central part of the beams 20 remote or at a distance from the end 21 and from the opposite end 22.

The contact zones 30 are equidistantly provided around the porthole 12.

The contact zones 30 have a relatively small size. They may have an oval shape or contour as can be seen in FIGS. 5 and 6.

The contact zones 30 are also located at the same distance from the porthole 12, and at the same distance from the center of the porthole 12.

Figure 6:
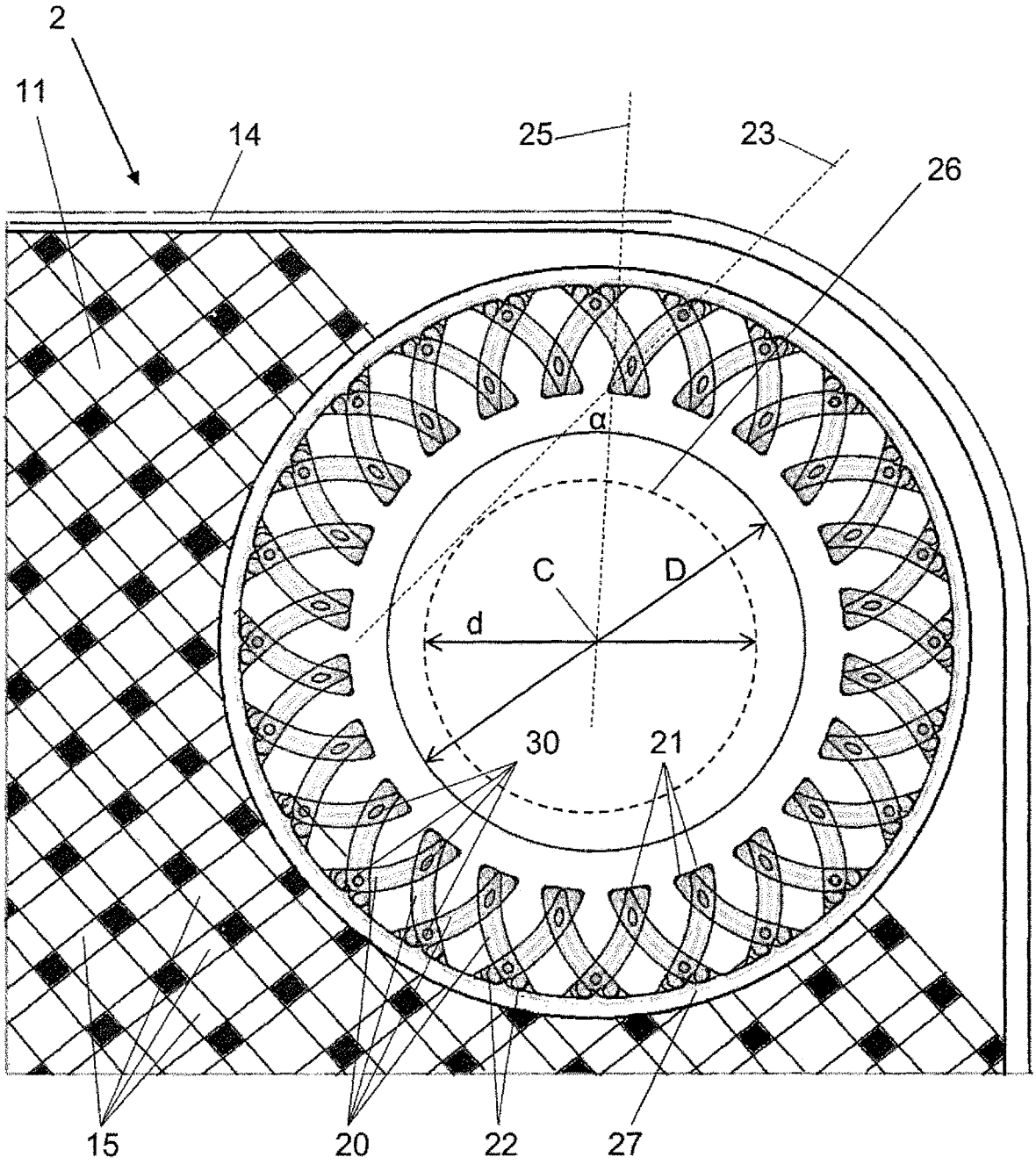
FIG. 6 discloses a more detailed plane view of a part of a porthole area of a heat exchanger plate of a plate heat exchanger according to a second embodiment of the invention.

FIG. 6 illustrates a second embodiment, which differs from the first embodiment in that each beam 20 of the porthole area has an elongated extension, but a curved shape, or slightly curved shape, thereby crossing the extension direction 23 of the beam 20 twice.

FIG. 6 illustrates two heat exchanger plates 2 adjacent to each other in the plate package of the plate heat exchanger 1, although both heat exchanger plates 2 have been shown with continuous lines.

The second embodiment differs from the first embodiment also in that the opposite end 22 of each of the beams 20 of the porthole area 13 is located at a distance from the end of the beams 15 of the heat exchanger area 11. Thus there is an annular area 27 extending around the porthole area 13. In FIG. 6, the annular area 27 extends between the porthole area 13 and the heat exchanger area 11 and between the porthole area 13 and the edge area.

The annular area 27 has no beams. The annular area 27 may be flat, or substantially flat.

Because of the curved shape, each of the beams 20 of the porthole area 13 of one heat exchanger plate 2 forms two contact zones 30 with the adjacent heat exchanger plate 2. More specifically, in the second embodiment, each beam 20 of the porthole area 13 of one heat exchanger plate 2 forms the two contact zones 30 with two beams 20 of the porthole area 13 of the adjacent heat exchanger plate 2 as can be seen in FIG. 6.

Both of the contact zones 30 are located at a distance from the end 21 of the respective beam 20, and at a distance from the opposite end 22 of the respective beam.

Even though the embodiments disclosed refer to permanently joined plate heat exchanger, but the invention may be applicable also to plate heat exchangers, in which the heat exchanger plates are joined in other ways, for instance by means of tie bolts. In this case, the edge area 14 may be configured to permit positioning of a gasket between adjacent heat exchanger plates.

The present invention is not limited to the embodiments disclosed and discussed, but may be varied and modified within the scope of the claims.

The invention claimed is:

1. A heat exchanger plate, comprising
a heat exchanger area,
at least two portholes each having a diameter,
at least two porthole surrounding areas, wherein each of the portholes is surrounded by a respective one of the porthole surrounding areas,
wherein the porthole surrounding areas are separated from each other,
wherein each porthole surrounding area comprises a corrugation of beams, and
wherein each of the beams has an end and extends along a respective extension direction towards the porthole,
wherein the extension direction of each of the beams and a radial line of the respective porthole passing through the end of the beam forms an acute angle; and
the acute angle is substantially equal for all of the beams.

2. A heat exchanger plate according to claim 1, wherein the extension direction of each beam in a respective porthole surrounding area is tangential with respect to a circle, which has a diameter smaller than the diameter of the respective porthole and is concentric with the respective porthole.

3. A heat exchanger plate according to claim 1, wherein the acute angle is larger than 10°.

4. A heat exchanger plate according to claim 1, wherein the acute angle is smaller than 80°.

5. A heat exchanger plate according to claim 1, wherein the end of each beam is located at a distance from the porthole.

6. A heat exchanger plate according to claim 1, wherein each of the beams has an opposite end.

7. A heat exchanger plate according to claim 6, wherein the opposite end of each beam is located within the respective porthole surrounding area.

8. A heat exchanger plate according to claim 6, wherein the opposite end of at least some of the beams is connected to a beam of a corrugation of the heat exchanger area.

9. A heat exchanger plate according to claim 1, wherein each beam has a curved shape thereby crossing the extension direction twice.

10. A plate heat exchanger comprising a plurality of heat exchanger plates according to claim 1.

11. A plate heat exchanger according to claim 10, wherein each beam of the porthole surrounding areas of one heat exchanger plate forms a contact zone with a beam of one of the porthole surrounding areas of an adjacent heat exchanger plate.

12. A plate heat exchanger according to claim 11, wherein each beam of the porthole surrounding area has a curved shape thereby crossing the extension direction twice, and wherein each beam of the porthole surrounding area of one heat exchanger plate forms two contact zones.

13. A plate heat exchanger according to claim 12, wherein each beam of the porthole surrounding area of one heat exchanger plate forms two contact zones with two beams of the porthole surrounding area of the adjacent heat exchanger plate.

14. A heat exchanger plate, comprising
a heat exchanger area,
at least two portholes each having a diameter,
at least two porthole surrounding areas, wherein each of the portholes is surrounded by a respective one of the porthole surrounding areas,
wherein the porthole surrounding areas are separated from each other,
wherein each porthole surrounding area comprises a corrugation of beams,
wherein each of the beams has an end and extends along a respective extension direction towards the porthole,
wherein the extension direction of each of the beams forms an acute angle to a radial line through the end of the beam; and
the beams being equidistantly positioned around the porthole.

15. A heat exchanger plate according to claim 14, wherein the extension direction of at least one-half of all of the beams in each porthole surrounding area is tangential with respect to a circle, which has a diameter smaller than the diameter of the respective porthole and is concentric with the respective porthole.

16. A heat exchanger plate according to claim 14, wherein the acute angle is larger than 10° and smaller than 80°.

17. A heat exchanger plate, comprising
a heat exchanger area,
at least two portholes each having a diameter,
at least two porthole surrounding areas, wherein each of the portholes is surrounded by a respective one of the porthole surrounding areas,
wherein the porthole surrounding areas are separated from each other, wherein each porthole surrounding area comprises a corrugation of beams, wherein each of the beams has an end and extends along a respective extension direction towards the porthole, wherein the extension direction of each of the beams forms an acute angle to a radial line through the end of the beam;

the acute angle is substantially equal for all of the beams, and the beams being equidistantly positioned around the porthole.

18. A heat exchanger plate according to claim 17, wherein the extension direction of at least one-half of all of the beams in each porthole surrounding area is tangential with respect to a circle, which has a diameter smaller than the diameter of the respective porthole and is concentric with the respective porthole.

19. A heat exchanger plate according to claim 17, wherein the acute angle is larger than 10° and smaller than 80°.

* * * * *